US006179550B1

(12) United States Patent
Schuster et al.

(10) Patent No.: US 6,179,550 B1
(45) Date of Patent: Jan. 30, 2001

(54) DEVICE FOR INDIVIDUALLY SEPARATING FLAT ARTICLES

(75) Inventors: Rudolf Schuster, Kirchheim; Josef Raschke, Pliening; Theodoro Rombauer, Mering, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/403,941

(22) PCT Filed: Apr. 30, 1998

(86) PCT No.: PCT/DE98/01205

§ 371 Date: Oct. 29, 1999

§ 102(e) Date: Oct. 29, 1999

(87) PCT Pub. No.: WO98/49082

PCT Pub. Date: Nov. 5, 1998

(30) Foreign Application Priority Data

Apr. 30, 1997 (DE) ..... 197 18 441
Aug. 4, 1997 (DE) ..... 197 33 734

(51) Int. Cl.[7] ..... B65G 59/06
(52) U.S. Cl. ..... 414/797.6; 271/35
(58) Field of Search ..... 271/35; 414/797.5, 414/797.6, 797.7

(56) References Cited

U.S. PATENT DOCUMENTS

| | | | | |
|---|---|---|---|---|
| 3,861,669 | | 1/1975 | Kubo et al. | 271/94 |
| 3,999,666 | | 12/1976 | Lloyd et al. . | |
| 4,397,456 | * | 8/1983 | Eberle | 271/35 X |
| 4,456,242 | * | 6/1984 | Morin | 271/35 X |
| 5,511,936 | | 4/1996 | Goldkuhle | 414/797 |
| 5,552,859 | | 9/1996 | Nakagawa et al. | 355/207 |
| 5,947,466 | * | 9/1999 | Romine | 271/35 X |

FOREIGN PATENT DOCUMENTS

| | | | | |
|---|---|---|---|---|
| 447241 | * | 5/1936 | (GB) | 414/797.6 |
| 1 396 848 | | 6/1975 | (GB) . | |
| 2 258 459 | | 2/1993 | (GB) . | |
| 58-135041 | * | 8/1983 | (JP) | 271/35 |
| 58-135042 | * | 8/1983 | (JP) | 271/35 |
| 61-206743 | * | 9/1986 | (JP) | 271/35 |
| 1-34830 | | 2/1989 | (JP) . | |
| WO 97/30918 | | 8/1997 | (WO) . | |

OTHER PUBLICATIONS

IBM–TDB, vol. 11, No. 11, p. 1587 (Apr. 1969).

* cited by examiner

*Primary Examiner*—Janice L. Krizek
(74) *Attorney, Agent, or Firm*—Schiff Hardin & Waite

(57) ABSTRACT

An apparatus for separating piece goods. The apparatus includes a plurality of piece goods that form a stack. The stack is supported by a stack magazine and stop. The apparatus further includes a pulling-off mechanism for separating and removing the piece goods for the stack by pivotably contacting the stack in a pulsating motion.

14 Claims, 4 Drawing Sheets

DEVICE FOR INDIVIDUALLY SEPARATING FLAT ARTICLES

BACKGROUND OF THE INVENTION

1. Field of the Invention

The invention relates to an apparatus for separating postal matter that is present in the form of flat, rectangular, particularly letter-like piece goods or articles (1) from a stack of a stacking magazine (2), using a pulling-off means (for example, 4) that includes a pulling-off organ or member (for example, 3) for the piece goods (1) to be respectively taken that can be moved transversely to the direction of stacking, wherein the stacking direction includes a vertical component, wherein the pulling-off member is arranged at the underside of the stack, wherein at least one detent (13) projecting into the stack region is provided at the underside of the stacking magazine (2) to the side of the pulling-off member for limiting the sliding motion of the stacked piece goods (1), and whereby pulling-off member, and wherein a seating surface of the pulling-off member is variable in its height position in the stack direction matched in time with the pull-off event.

2. Description of the Prior Art

A similar apparatus has been disclosed, for example, by U.S. Pat. No. 5,552,859 ("the '859 patent"). In the '859 patent a paper stack can be placed into a container whose floor includes a window-like clearance under which a partially circle-shaped drive roller is arranged. The outside contour thereof is fashioned and arranged such in the manner of a cam plate that it is located under the floor in the quiescent condition. In order to pull the lowest sheet from the stack, the drive roller is turned and thereby has its enlarged section engaging into the stack region and, as a result the bottom sheet is displaced in the rotational sense. The transition to the expanded section is angularly fashioned, so that a motion pulse acting in the stack direction derives during the rotation.

U.S. Pat. No. 5,511,936 also discloses a separating mechanism for letters wherein the piece goods are lifted off from the upper side of a stack with a suction grab and are carried off with circulating belts.

Another apparatus for separating flat postal matter is known for example from U.S. Pat. No. 5,511,936. According to this reference, stacked letters are separated using a conveyor belt that, with the aid of a suction opening, suctions the respective next letter and draws it out from the stack. Here the subsequent letter presses on the one that is to be drawn out, which makes the pulling off more difficult. In the case of thin letters in particular, it is possible for the subsequent letter to be drawn along due to adhesive friction, especially if the first letter has been partially drawn out and the next one is pressed against the conveyor belt.

SUMMARY OF THE INVENTION

The invention is based on the object of increasing functional reliability in the separation of the piece goods.

Given the stacking magazine with a vertical component, the problem derives that the stack pressure can be very high given a great stack height. Due to the impulse exerted on the stack, this pressure is at least partially reduced, and an adhesive-type sticking together of the two lower piece goods is avoided. At the same time, the lowest piece good is grasped by pulling-off member, and is set into motion transverse to the stacking direction.

The risk that the next piece good will be entrained is thus substantially reduced. As a result of the narrow stop surfaces at the back side, the bottom piece good can be removed from the region thereof in a short time before the full stack pressure is built up again on the remaining piece goods that slide in. Since the stop can then already be arranged above the seating surface of the pulling-off member again, it is possible to hold the remaining stack back at a distance until the bottom piece good has been moved out of the stack region without pressure.

What is achieved by the diagonal haul-off is that piece goods of different sizes are also reliably seized by the conveyor belt. Here this belt is arranged in such a way that the center of gravity of the piece goods is located approximately in the center of the conveyor belt. The lateral stops grasp the piece goods at least in the region of the other diagonals. This region likewise covers the center of gravity of the piece good, so that this piece good is securely held back during the folding down of the conveyor belt.

What is also achieved by the diagonal attitude of the piece goods is that the piece goods lie at the narrow stop along two back edges and can be reliably held without the distance until leaving the stop region becoming too great.

The pulling-off mechanism can for example be fashioned as a pulling-off drum in which the pulling-off member includes a rotating suction roller. The pulling-off mechanism can for example be mounted in resiliently flexible fashion, and can be moved in the stacking direction by a correspondingly controlled drive.

In an embodiment, the stacking magazine includes a slanting stacking direction that is inclined relative to the pulling-off direction such that the slide-in speed of the piece goods can be set to a suitable size. As a result of the force of gravity, the slant facilitates the alignment of the back edges of the piece goods relative to the pulling-off direction at the corresponding sidewalls of the stack magazine. In particular, piece goods of greatly varying size can also be guided in the stack in a defined manner and seized by the stop surfaces. The gradient of the stacking magazine can be kept small enough that the postal material can be inserted in an ergonomically advantageous manner.

The slant of the stacking magazine yields a pulling off direction directed obliquely upwards that uses the effect of gravity to improve the pulling-off process. Moreover, it is possible to position the magazine correspondingly lower, so that it can more easily be refilled and operated manually.

Due to the impulse-type motion at least the lowest piece goods can be moved, that is, compressed, upwards. In the upper dead center of the motion, the pulling-off member is actuated in the direction of pulling off, and is simultaneously moved downward. At the same time, for example the pulling-off member is connected to a suction source, by which mechanism the lowest piece good is suctioned on and is set into motion before the other piece goods can slide back.

In an embodiment, the conveyor belt includes a planar seating surface that facilitates the removal of the piece goods and the defined alignment relative to the stop surfaces.

In an embodiment, due to the movable pulling-off member, the relieving pulse can act on large-area on the stack, wherein the piece goods are only slightly deformed. The pulling-off member always remains in contact with the lowest piece good during the motion, so that the pulling-off motion can begin immediately when the upper dead center is reached. The motion of the pulling-off organ can be generated in a simple way on the basis of a motion of the entire haul-off means.

The pivotable motion of the circulating conveyor belt can be produced in particularly simple and precise fashion. The deflection roller can thereby serve as drive roller, as a result whereof the coupling of the drive motor for the conveyor belt is facilitated.

In an embodiment, due to the arrangement, in the pivoting of the conveyor belt away from the stack the pulling-off side is opened particularly wide, so that the piece good can be guided out freely.

In an embodiment, the stops make it possible to pivot the conveyor belt away from the magazine so far that the piece good to be drawn out can no longer be reached by the subsequent one. The pivot motion can be continued far enough that a suitable transport angle for the transfer of the piece good e.g. to a following belt can be set. Due to the wide-angled folding capacity, in particular, it is possible to decouple the incline of the magazine from the conditions of the transfer, and to set it for optimal sliding back and stopping conditions. The desired motion profile of the linear conveyor can be set in a simple way with a cam plate.

In an embodiment, due to the development, the impulse can be produced easily. The upper side—facing the piece good—of the stop can be moved between a height level above and below the support surface of the pulling-off member, so that the piece good can either lie fully on the pulling-off member or can be held back in relation to it.

Due to the development, the motion pulse can be generated with little force outlay since the stack need not be lifted here.

The angle of pulling off of the belt conveyor runs, oblique to the stacking direction at an obtuse angle, in order to enable an advantageous angle for the transfer to another transport means. The postal material will then stand in the stack at an incline correspondingly oblique to the stacking direction, so that the angle between the two guide walls must be maintained greater than 90°. The stacking direction can be kept correspondingly flat, which facilitates the manual insertion of partial stacks of the piece goods.

DESCRIPTION OF THE PREFERRED EMBODIMENT

Figure 1:
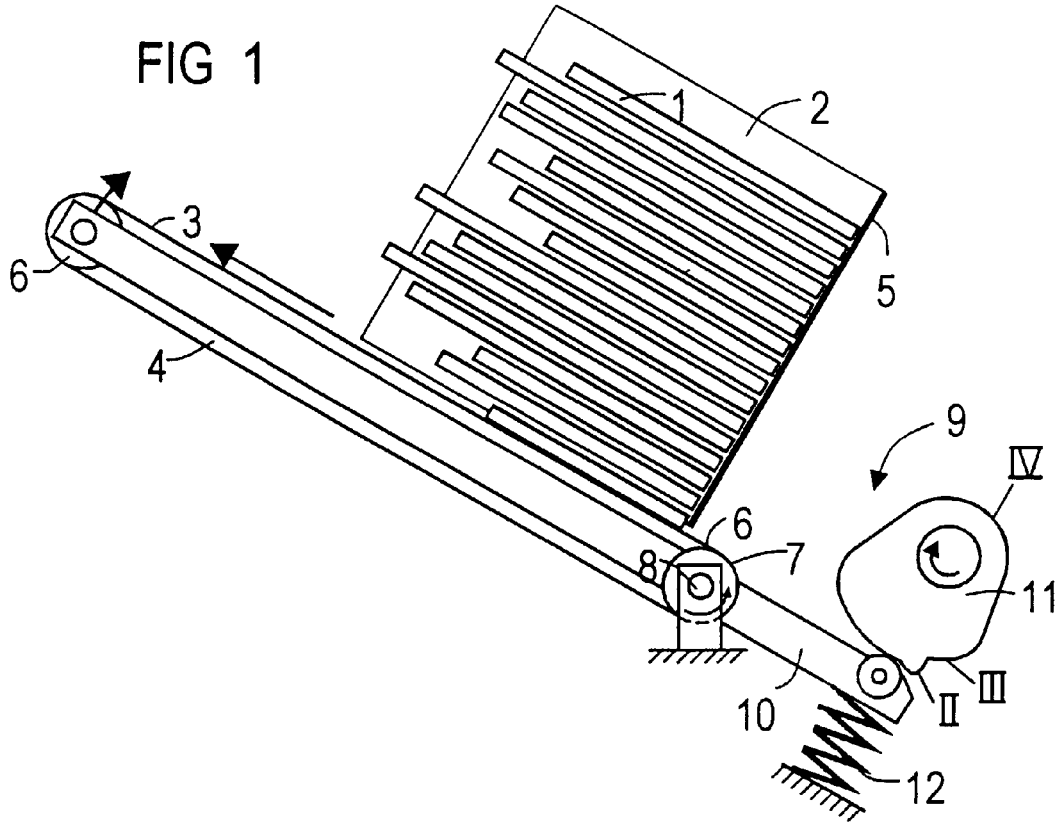
FIG. 1 shows a side view of an apparatus for member flat piece goods, having a stacking magazine and a rotary actuator for a linear conveyor.

According to FIG. 1, flat piece goods 1 of various sizes are combined in a stacking magazine 2 that stands obliquely in the space. This magazine is inclined to the vertical in such a way that due to the effect of gravity on the lower side of the stacking magazine 2, piece goods 1, for example letters, are supported on a perpendicular to the stacking direction on a conveyor belt 3 of a linear conveyor 4.

The linear conveyor 4 includes two deflecting rollers 6 for the conveyor belt, of which one is fashioned as a drive roller 7. The linear conveyor 4 is mounted pivotably about a pivot axle that coincides with the midaxis of the drive roller 7, which pivot axle is arranged near the lower side 5 of the stacking magazine 2.

A rotary actuator 9 for the linear conveyor 4 includes a pivoted lever 10, a cam plate 11 serving as pulse generator and a pressure spring 12 that is arranged on the side of the pivoted lever 10 opposite the cam plate 11. The cam plate 11 acts on the pivoted lever 10 in such a way that this lever, together with the linear conveyor 4, can be pivoted into various angular positions. Reference characters II, III and IV thereby mark the segments of the curved path of the cam plate 11 that mesh with the pivoted lever 10 according to FIGS. 2, 3, and 4.

The arrows shown in FIG. 1 show the various directions of motion of the individual elements. Via rotation of the cam plate 11, the linear conveyor 4 is pivoted toward the piece good, corresponding to the left upper pivot arrow.

Figure 2:
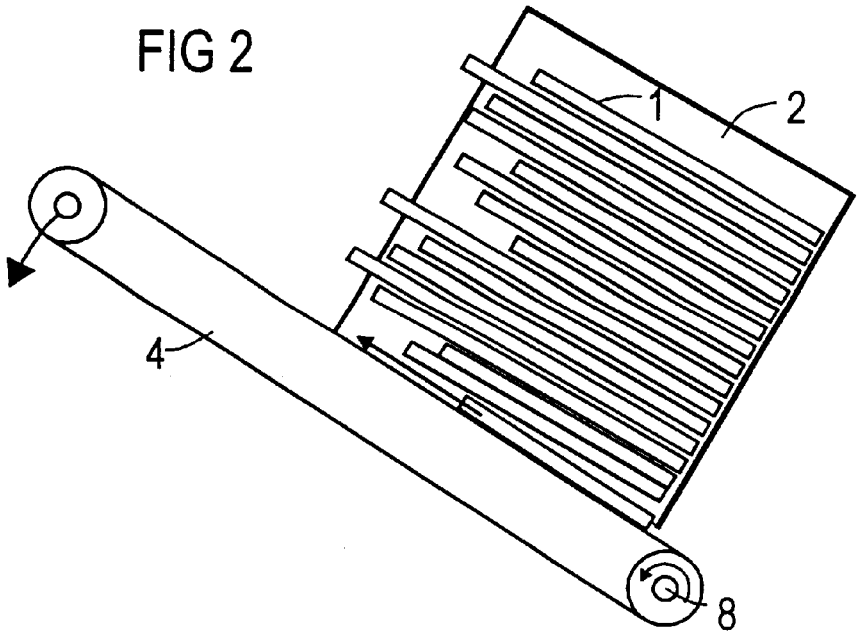
FIG. 2 shows the apparatus according to FIG. 1, in a subsequent work phase without the rotary actuator.
Figure 3:
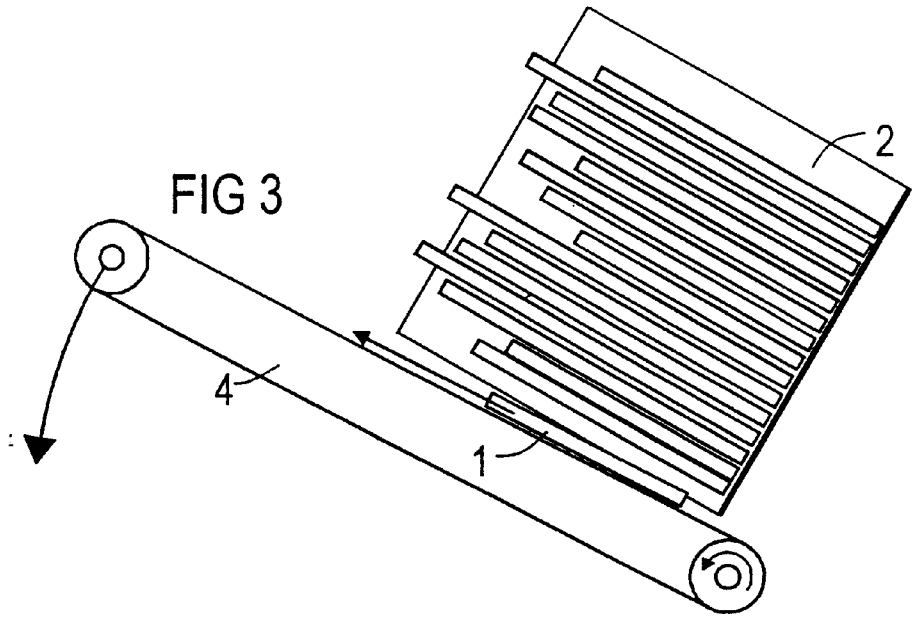
FIGS. 3 and 4 show the apparatus according to FIG. 2 in the subsequent work phases.

This position is shown in FIG. 2. The pivot motion of the linear conveyor thereby has enough impulse that the piece goods, for example in the form of letters, are pressed together in the lower stack region. Immediately following this, the linear conveyor 4 is pivoted back past its initial position, into the position shown in FIG. 3. The lowest piece good is thereby carried along for example by means of suction openings present in the conveyor belt 3. The incline of the stacking magazine 2, deviating from the vertical, is thereby selected such that the piece good 1 located above the lowest one slides back more slowly than the pivoting away of the linear conveyor 4. The lowest piece good can thus be guided out of the stacking region in the direction of conveying, at least for a short path, without the pressure of the rest of the stack.

Figure 4:
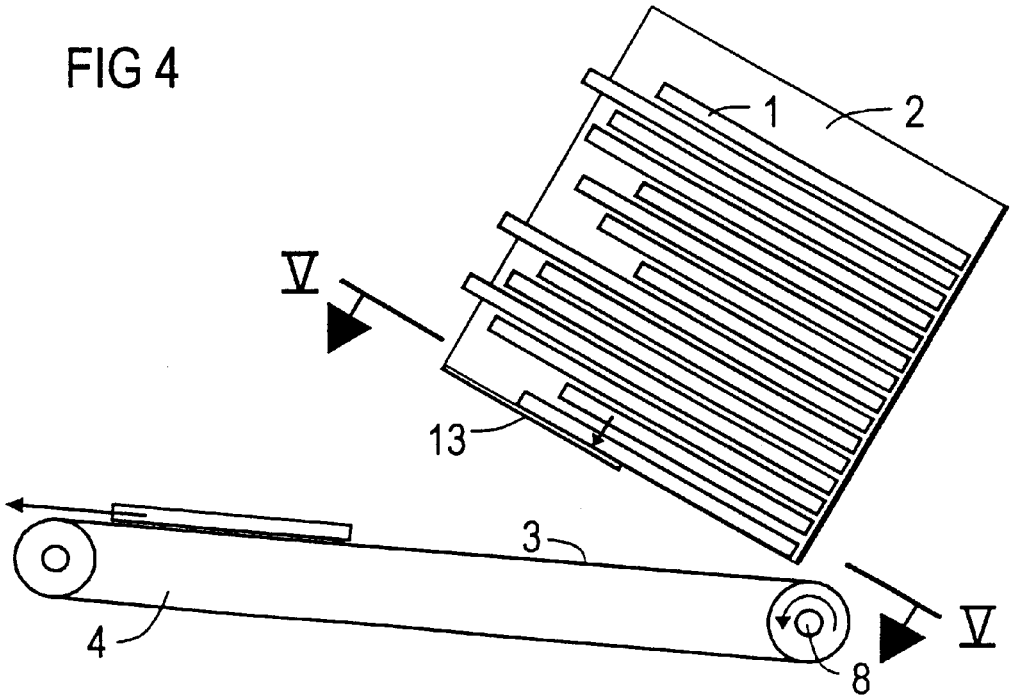

Subsequently, the linear conveyor 4 is pivoted, with a large pivot angle, into the position shown in FIG. 4, in order to bring the piece good 1 that has been guided out into a suitable position for transfer, for example to a subsequent conveyor. A stop 13 that protrudes into the stack region is attached to the underside of the stacking magazine 2, which stop prevents the piece good 1 from falling out of the stacking magazine 2.

Figure 5:
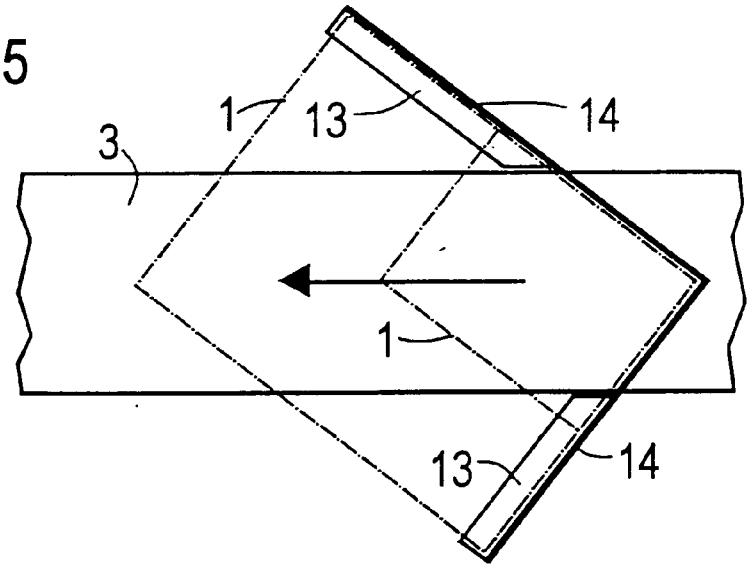
FIG. 5 shows a section through the apparatus along the line V—V in FIG. 4.

In FIG. 5, it can be seen that the trough-type stacking magazine 2 includes two side walls that stand perpendicular to one another and that form an L-shaped guide profile 14 for the piece goods 1, so that this is applied to the two limbs of the guide profile 14 by the force of gravity. The angular position of the guide profile 14 to the conveyor belt 3 is selected such that its center track is located in the region of the diagonals of the letter-type piece good 1. Due to the defined seating on the guide profile 14, it is thereby ensured that even a piece good 1 having a different size is securely grasped by the conveyor belt 3.

This belt is narrower than the length of the diagonal of the smallest piece good 1 that is to be separated. The web-type stops 13 extend at both sides of the conveyor belt 3, along the lower edges of the guide profile 14. They protrude into the stacking region in such a way that even the smallest piece good 1 is covered in the region of the center of gravity at its corners extending past the conveyor belt 3, and are securely applied until the linear conveyor 4 has again been pivoted back into its initial position, shown in FIG. 1.

Figure 6:
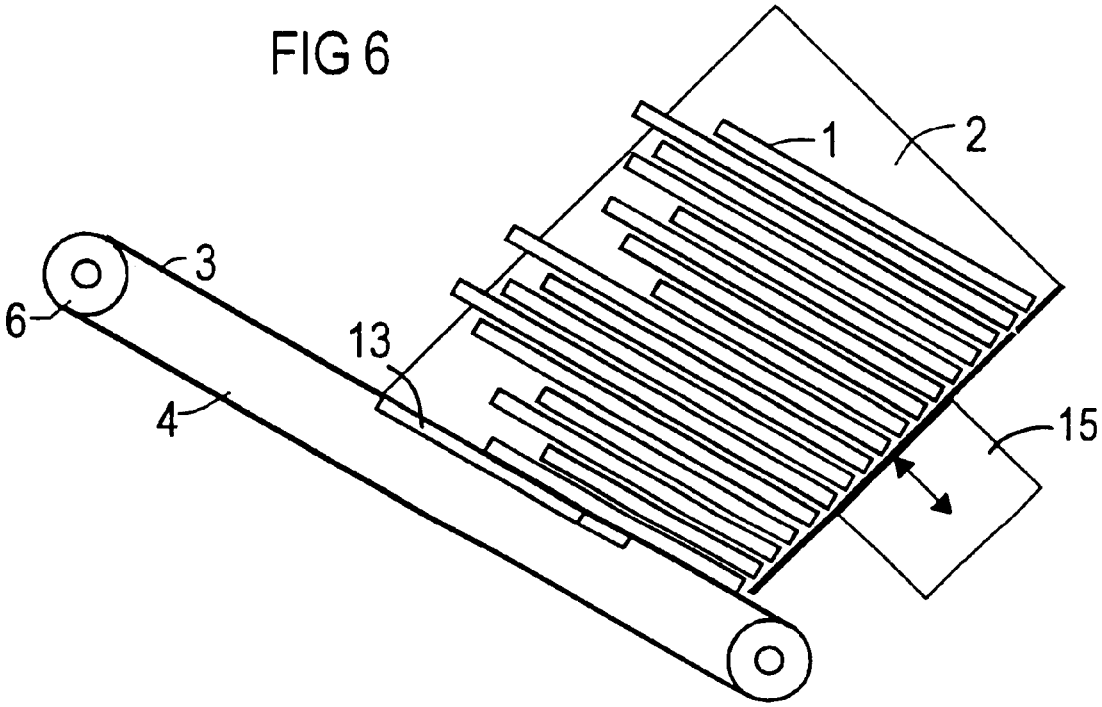
FIG. 6 shows the apparatus according to FIG. 1 having a modified stacking magazine and without the rotary actuator.

In FIG. 6, an impulse generator 15 is additionally placed on the stacking magazine 2, which generator emits shock-type impulses to the magazine walls, and thus to the stack, according to the double arrow, transverse to the stacking direction. These shocks can for example be produced temporarily at the beginning of the pulling-off process, or also permanently, in the manner of vibrators. By this means, the piece goods of different sizes are securely oriented to the side walls, so that they lie against the side walls in a defined fashion with two sides bordering on one another. Moreover, the impulses of the impulse generator (15) reduce the adhesive friction between the piece goods, and thus facilitate the pulling off of the lowest piece good by the conveyor belt.

Here the stacking magazine is arranged at a very flat angle of incline, which is ergonomically very advantageous for the manual insertion of partial stacks of the piece goods 1 in a low operating position. The initial position of the conveyor belt 3 is inclined at an obtuse angle to the stacking direction, which is advantageous for the forwarding of the piece goods 1. These thereby stand not perpendicular but rather at a correspondingly oblique angle to the stacking direction. In order to adapt the sidewalls of the stacking magazine 2 to the oblique position of the piece goods, the sidewalls stand at an angle to one another of greater than 90°. Despite the low angle of incline of the stack, the impulse generator 15, fashioned as a vibrator, enables a reliable sliding back of the piece good.

Figure 7:
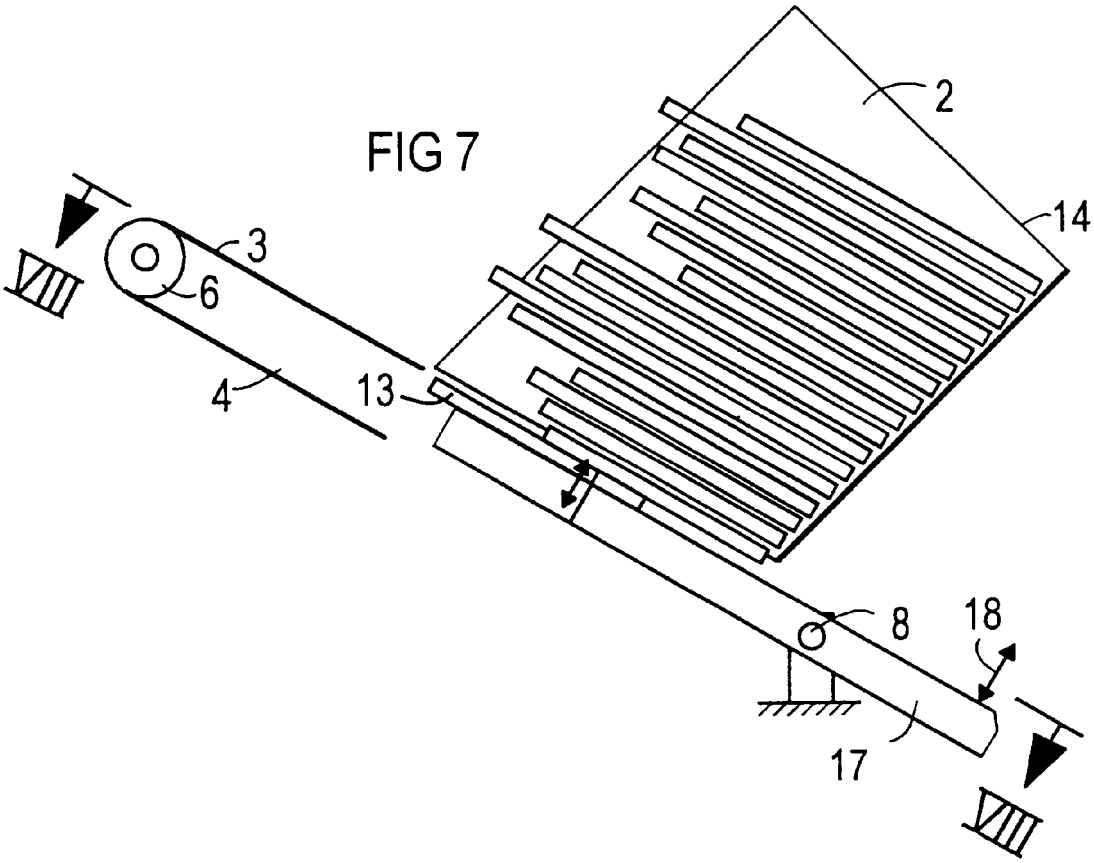
FIG. 7 shows the apparatus according to FIG. 6 with a rotary actuator for a stop for the piece goods.
Figure 8:
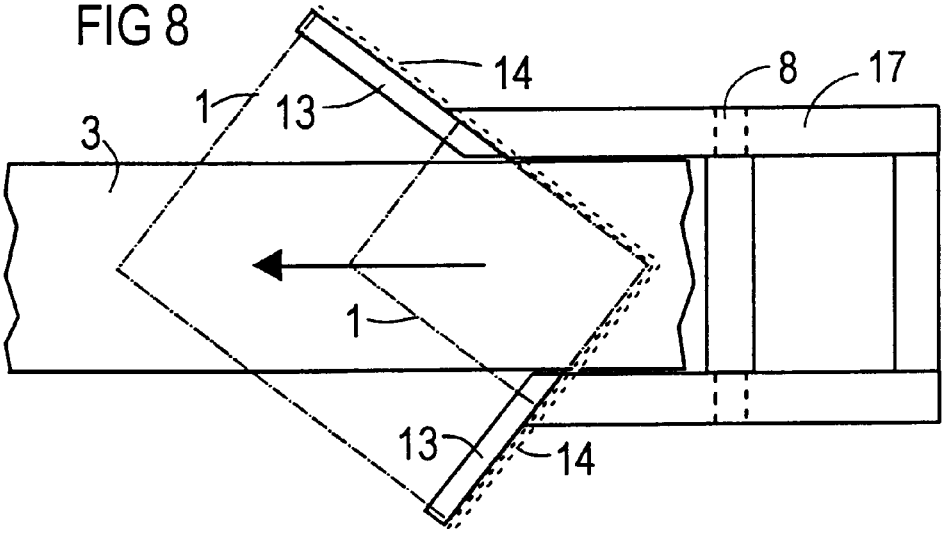
FIG. 8 shows a section along the line VIII—VIII in FIG. 7.

According to FIGS. 7 and 8, the conveyor belt 3 is of stationary construction, and the stop 13 is fastened not to the guide profile 14 but rather to an oscillating arm 17 that can be pivoted about its pivot axle 8 by another rotary actuator 18, in such a way that the stops 13 are pressed against the stacked piece good in impulsed fashion, and can be moved away from the stacked piece good. The stops 13 are thereby briefly lowered to a level below the conveyor belt 3, until the respective piece good 1 has left the support region of the stops 13. Immediately following this, these stops are moved back into their initial position above the level of the belt, so that the subsequent piece good 1 is held back.

Although modifications and changes may be suggested by those skilled in the art, it is the intention of the inventors to embody within the patent warranted hereon all changes and modifications as reasonably and properly come within the scope of their contribution to the art.

We claim as our invention:

1. An apparatus for separating piece goods from a stack of said piece goods, said stack comprising a stack end, each of said piece goods having a diagonal length, said apparatus comprising a stacking magazine having a pair of sidewalls extending at right angles to each other to form a corner, a stop being positioned adjacent a lower edge of each of said sidewalls, said magazine and stops holding the stack of piece goods with the stack end engaging said stops; a pulling-off mechanism for separating and removing said piece goods from said stack in a haul-off direction, said haul-off direction comprising a direction along said diagonal length of said piece goods away from the corner of said magazine, said pulling-off mechanism comprising a pulling-off member having a seating surface, said pulling-off member being positioned below said stack end, the seating surface contacting the stack end due to relative movement between the seating surface and the stack end, said relative movement applying at least an impulse motion to the stack end, said seating surface having a seating surface width less than the diagonal length of each of said piece goods so that with the impulse motion of contacting the end of the stack, a lowermost piece goods is transported from the stack in a haul-off direction away from the corner of said magazine.

2. An apparatus according to claim 1 wherein said piece goods comprise flat postal articles.

3. An apparatus according to claim 1, wherein said stacking magazine is oriented at an angle relative to the pulling-off mechanism.

4. An apparatus according to claim 1, wherein the impulse motion is produced by movement of the pulling-off member relative to the stack end, said impulse motion being directed toward said stack end.

5. An apparatus according to claim 1, wherein the impulse motion is produced by movement of said pulling-off member relative to the stack end, said impulse motion being directed away from said stack end.

6. An apparatus according to claim 1, wherein said impulse motion is produced by movement of said pulling-off member relative to the stack end, said impulse motion being directed toward and away from said stack end.

7. An apparatus according to claim 1, wherein each of the stops is attached to a lower edge of said sidewalls of the magazine.

8. An apparatus according to claim 1 wherein said pulling-off mechanism comprises a linear conveyor and wherein said pulling-off member comprises a conveyor belt attached to said linear conveyor.

9. An apparatus according to claim 8 wherein said linear conveyor comprises a plurality of deflection rollers and a drive roller for moving said conveyor belt, said drive roller comprises a drive roller axis, and said linear conveyor being pivotably mounted about said drive roller axis.

10. An apparatus according to claim 9, wherein the corner of said stacking magazine is positioned in the haul-off direction from the drive roller.

11. An apparatus according to claim 8 wherein said apparatus comprises an oscillating arm being pivotable about an oscillating arm axis, said stops being attached to said oscillating arm for contacting said stack end with said impulse motion, and said conveyor belt remains stationary for receiving said piece goods.

12. An apparatus according to claim 11 wherein said impulse motion of said stops is directed towards said stack end.

13. An apparatus according to claim 11 wherein said impulse motion of said stops is directed away from said stack end.

14. An apparatus according to claim 11 wherein said impulse motion of said stops is directed towards and away from said stack end.

* * * * *